US011497095B1

(12) United States Patent
Wang et al.

(10) Patent No.: US 11,497,095 B1
(45) Date of Patent: Nov. 8, 2022

(54) LED LIGHTING DEVICE CAPABLE OF ADJUSTING COLOR TEMPERATURE BY HARDWARE AND SOFTWARE COOPERATIVE CONTROL TO ACHIEVE HIGH-PERFORMANCE LIGHT OUTPUT

(71) Applicants: GENERAL LUMINAIRE (SHANGHAI) CO., LTD., Shanghai (CN); GENERAL LUMINAIRE (KUNSHAN) CO., LTD., Kunshan (CN)

(72) Inventors: Yung-Hong Wang, Shanghai (CN); Chien Lee, Shanghai (CN); Yun Zhang, Shanghai (CN)

( * ) Notice: Subject to any disclaimer, the term of this patent is extended or adjusted under 35 U.S.C. 154(b) by 0 days.

(21) Appl. No.: 17/496,741

(22) Filed: Oct. 7, 2021

(51) Int. Cl.
*H05B 45/24* (2020.01)
*H05B 45/325* (2020.01)

(52) U.S. Cl.
CPC ..... *H05B 45/24* (2020.01); *H05B 45/325* (2020.01)

(58) Field of Classification Search
CPC ..... H05B 45/24
See application file for complete search history.

(56) References Cited

U.S. PATENT DOCUMENTS 8,080,819 B2 * 12/2011 Mueller ..... H05B 45/3725 257/E25.032

* cited by examiner

*Primary Examiner* — Vip Patel

(57) ABSTRACT

An LED lighting device capable of adjusting color temperature by software and hardware cooperative control to achieve high-performance output includes at least one light source and a drive circuit. The light source includes first-wavelength LED, second-wavelength LED, third-wavelength LED and fourth-wavelength LED. When a modulator is operated to select only one of the first-wavelength LED, the second-wavelength LED, the third-wavelength LED and the fourth-wavelength LED to receive a maximum rated current, the drive circuit outputs four times of the maximum drive power to the corresponding LEDs; or when the first-wavelength LED, the second-wavelength LED, the third-wavelength LED and the fourth-wavelength LED receive a quarter of the maximum rated current separately, the drive circuit outputs a quarter of the maximum drive power to the LEDs separately, and the output pulse width of the drive power will be modulated to maintain the light source to carry a constant rated power.

7 Claims, 4 Drawing Sheets

LED LIGHTING DEVICE CAPABLE OF ADJUSTING COLOR TEMPERATURE BY HARDWARE AND SOFTWARE COOPERATIVE CONTROL TO ACHIEVE HIGH-PERFORMANCE LIGHT OUTPUT

BACKGROUND

Technical Field

The present disclosure relates to the technical field of adjustable color-temperature LED lighting devices. More particularly, the present disclosure relates to an LED lighting device capable of adjusting color temperature by a software and hardware cooperative control to achieve high-performance output, so that a constant power can be outputted by performing a direct hardware current modulation and then a software modulation to improve the working efficiency of the LED.

Description of Related Art

In recent years, light emitting diodes (LEDs) have been popular to the public and are widely used in daily lighting devices, and LED components are roughly divided according to their light emitting characteristics into a high color temperature LED component with a blue luminous color and a low color temperature LED component with a yellow luminous color. Therefore, there are lighting devices with adjustable color temperature on the market, which are provided for users to change and set a light color according to different combinations of high color temperature LED components and low color temperature LED components to meet actual application requirements. For example, a lighting device having a red LED, a green LED, a blue LED and a white LED can use each of the LEDs to statically output a monochromic beam of a red, green, blue or white light, and also can use the LEDs to dynamically mix the lights to output various color beams. Obviously, the four LEDs share the electric energy outputted by an LED drive circuit, so that the four LEDs will receive a quarter of total power separately when the mixed light is set to full brightness, and when the monochromic full-brightness lighting is turned on and the single LED receives the total power, the light emitting efficiency of the LED will decrease and fail to meet user requirements, due to the physical property of the LED (wherein, the larger the power, the smaller the efficiency).

In view of the aforementioned drawback of the conventional LED lighting device, it is a main subject for this disclosure to find a way to maintain the working power substantially carried by the LED when switching the lighting mode of the LED in order to overcome the drawback of the prior art.

SUMMARY

In view of the aforementioned problems, it is a primary objective of the present disclosure to provide an adjustable color-temperature LED lighting device that switches to a high or low current by hardware directly and modulates the pulse width by software in order to make the LED drive power constant during the modulation of color temperature, and achieve high-performance light output.

To achieve the foregoing and other objectives, the present disclosure discloses an LED lighting device capable of adjusting color temperature by a software and hardware cooperative control to achieve high-performance output, and the LED lighting device includes at least one light source and a drive circuit. The light source includes a first-wavelength LED, a second-wavelength LED, a third-wavelength LED and a fourth-wavelength LED. The drive circuit is electrically coupled to the light source and includes a primary power output unit, a microcontroller unit and a hardware current switching unit, a secondary power output unit and a constant power programming unit, and the microcontroller unit is telecommunicatively coupled to the hardware current switching unit, and the secondary power output unit is electrically coupled to the primary power output unit, the hardware current switching unit, and the constant power programming unit, and the primary power output unit outputs a maximum drive power to the secondary power output unit. When the microcontroller unit receive a drive signal to learn that only one of the first-wavelength LED, the second-wavelength LED, the third-wavelength LED and the fourth-wavelength LED receives a maximum rated current, the hardware current switching unit switches the resistance of the secondary power output unit to output four times of the maximum drive power to the corresponding first-wavelength LED, second-wavelength LED, third-wavelength LED or fourth-wavelength LED. When the microcontroller unit receives the drive signal to learn that the first-wavelength LED, the second-wavelength LED, the third-wavelength LED and the fourth-wavelength LED receive a quarter of the maximum rated current separately, the hardware current switching unit switches the resistance of the secondary power output unit to output a quarter of the maximum drive power to the first-wavelength LED, the second-wavelength LED, the third-wavelength LED and the fourth-wavelength LED separately, and the constant power programming unit modulates the pulse width of the output power to maintain the carrying power of the light source to be a constant rated power.

Wherein, the first-wavelength LED, the second-wavelength LED, the third-wavelength LED and the fourth-wavelength LED are a red LED, a green LED, a blue LED and a white LED respectively. The maximum rated current is 1.4 A, and a quarter of the maximum rated current is 0.35 A. The LED lighting device capable of adjusting color temperature further includes a modulator telecommunicatively coupled to the microcontroller unit for transmitting the drive signal. The constant power programming unit modulates the pulse width of the output power by a pulse width modulation (PWM) technology. The secondary power output unit has an output control element which is a metal oxide semiconductor field effect transistor (MOSFET). The adjustable color-temperature LED lighting device further includes a cooling element connected to at least one of the light source and the drive circuit, and the cooling element has a power dissipation wattage equal to the rated power wattage carried by the light source.

In summation of the description above, this disclosure uses the hardware current switching unit to switch the resistance of the secondary power output unit to output four times of the maximum drive power for the monochromic full-brightness light during the modulation of color temperature (wherein the first-wavelength LED, the second-wavelength LED, the third-wavelength LED or the fourth-wavelength LED is turned on with the maximum brightness). When the four color LEDs are lit and in a mixed light status, the hardware current switching unit switches the resistance of the secondary power output unit to output a quarter of the maximum drive power, and the constant power programming unit modulates the pulse width of the output power by a software modulation technology to maintain a constant rated power carried by the light source. In this way, the overall light output efficiency of the device and the economic value of the product can be improved.

In other words, the discloser of the present disclosure has continuously collected practical data and found that when the four color LEDs are all turned on and situated a mixed light state, the LED working power cannot be reduced substantially and the attenuation of the LED light emitting efficiency cannot be avoided, if only the pulse width is adjusted through the PWM technology to achieve the purpose of reducing the carrying power of the LED. For this reason, this disclosure designs the hardware current switching unit to directly set the hardware current carried by the LED, and then adjusts the pulse width through the PWM technology to provide the constant working power of the LED, so as to truly improve the light emitting efficiency of the light source and the overall product quality.

DESCRIPTION OF THE EMBODIMENTS

This disclosure will now be described in more detail hereinafter with reference to the accompanying drawings that show various embodiments of the invention.

Figure 1:
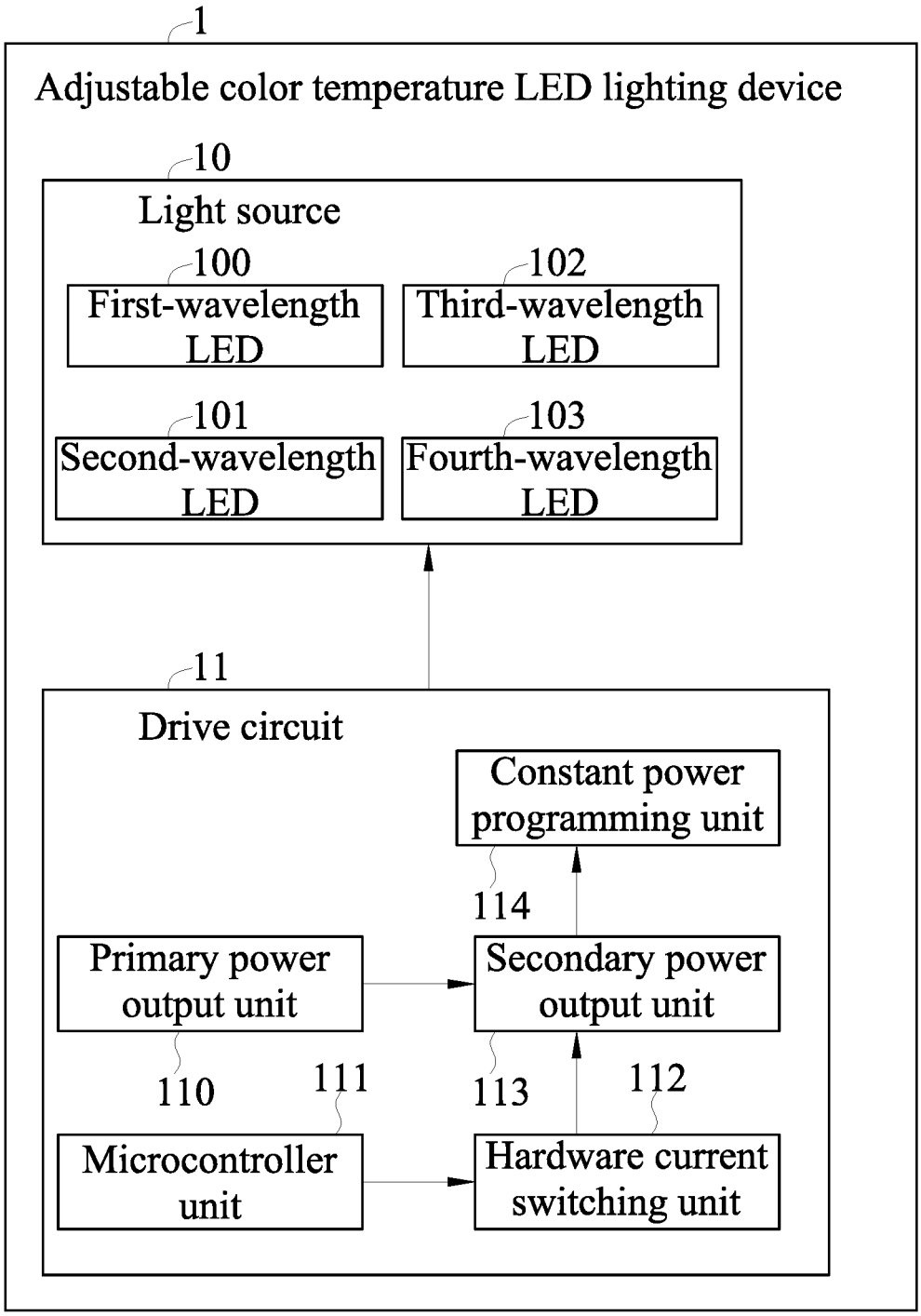
FIG. 1 is a schematic block diagram of a first preferred embodiment of this disclosure.

With reference to FIG. 1 for the schematic block diagram of a preferred embodiment of this disclosure, an LED lighting device capable of adjusting color temperature 1 by a software and hardware cooperative control to achieve high-performance output includes at least one light source 10 and a drive circuit 11. The light source includes a first-wavelength LED 100, a second-wavelength LED 101, a third-wavelength LED 102 and a fourth-wavelength LED 103, and the drive circuit 11 is electrically connected to the light source 10 and includes a primary power output unit 110, a microcontroller unit 111, a hardware current switching unit 112, a secondary power output unit 113, and a constant power programming unit 114. The microcontroller unit 111 is telecommunicatively coupled to the hardware current switching unit 112, and the secondary power output unit 113 is electrically coupled to primary power output unit 110, the hardware current switching unit 112, and the constant power programming unit 114, and the primary power output unit 110 outputs a maximum drive power to the secondary output power unit 113. When the microcontroller unit 111 receives a drive signal to learn that only one of the first-wavelength LED 100, second-wavelength LED 101, third-wavelength LED 102 and fourth-wavelength LED 103 receives a maximum rated current, the hardware current switching unit 112 will switch the resistance of the secondary power output unit 113 to output four times of the maximum drive power to the corresponding first-wavelength LED 100, second-wavelength LED 101, third-wavelength LED 102 or fourth-wavelength LED 103, and the constant power programming unit 114 modulates the pulse width of the output power to maintain the carrying power of the light source 10 to be a constant rated power. When the microcontroller unit 111 receives the drive signal and learns that the first-wavelength LED 100, the second-wavelength LED 101, the third-wavelength LED 102 and the fourth-wavelength LED 103 receive a quarter of the maximum rated current separately, the hardware current switching unit 112 will switch the resistance of the secondary power output unit 113 to output a quarter of the maximum drive power to the first-wavelength LED 100, the second-wavelength LED 101, the third-wavelength LED 102 and the fourth-wavelength LED 103 separately, and the constant power programming unit 114 modulates the pulse width of the output power to maintain the carrying power of the light source 10 to be a constant rated power.

Figure 2:
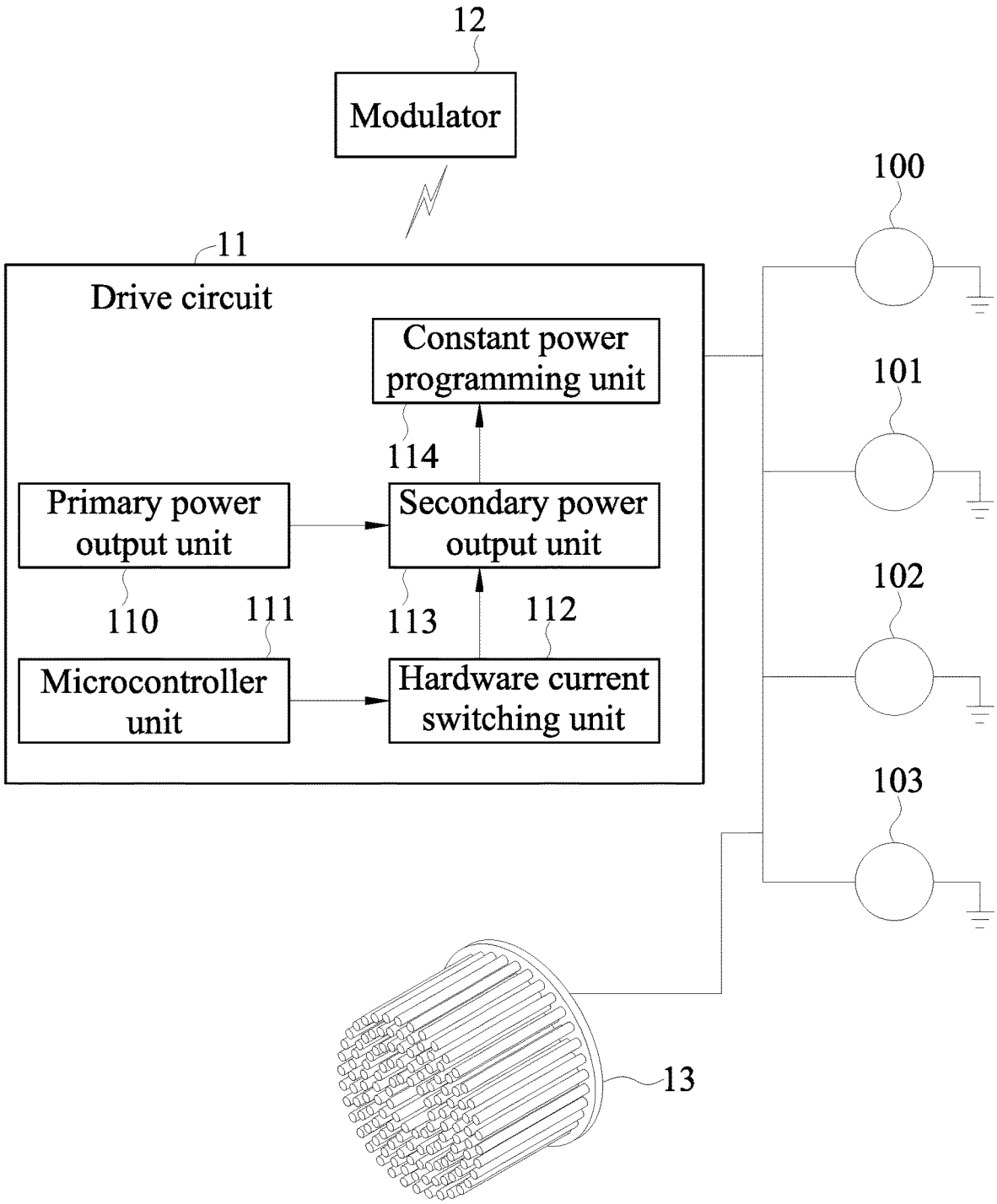
FIG. 2 is a schematic view of the first preferred embodiment of this disclosure.
Figure 3A:
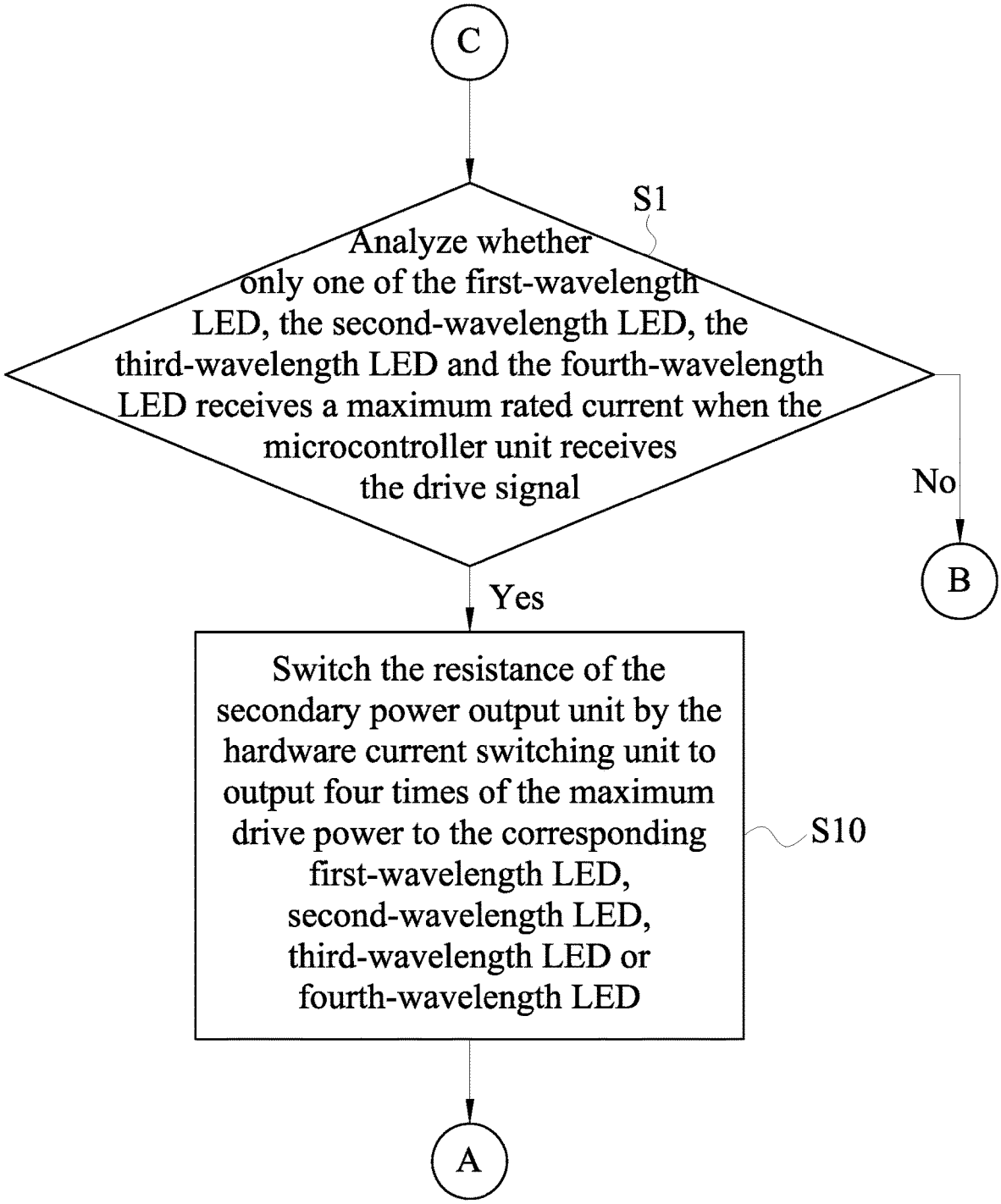
FIGS. 3A and 3B are flow charts of a second preferred embodiment of this disclosure.
Figure 3B:
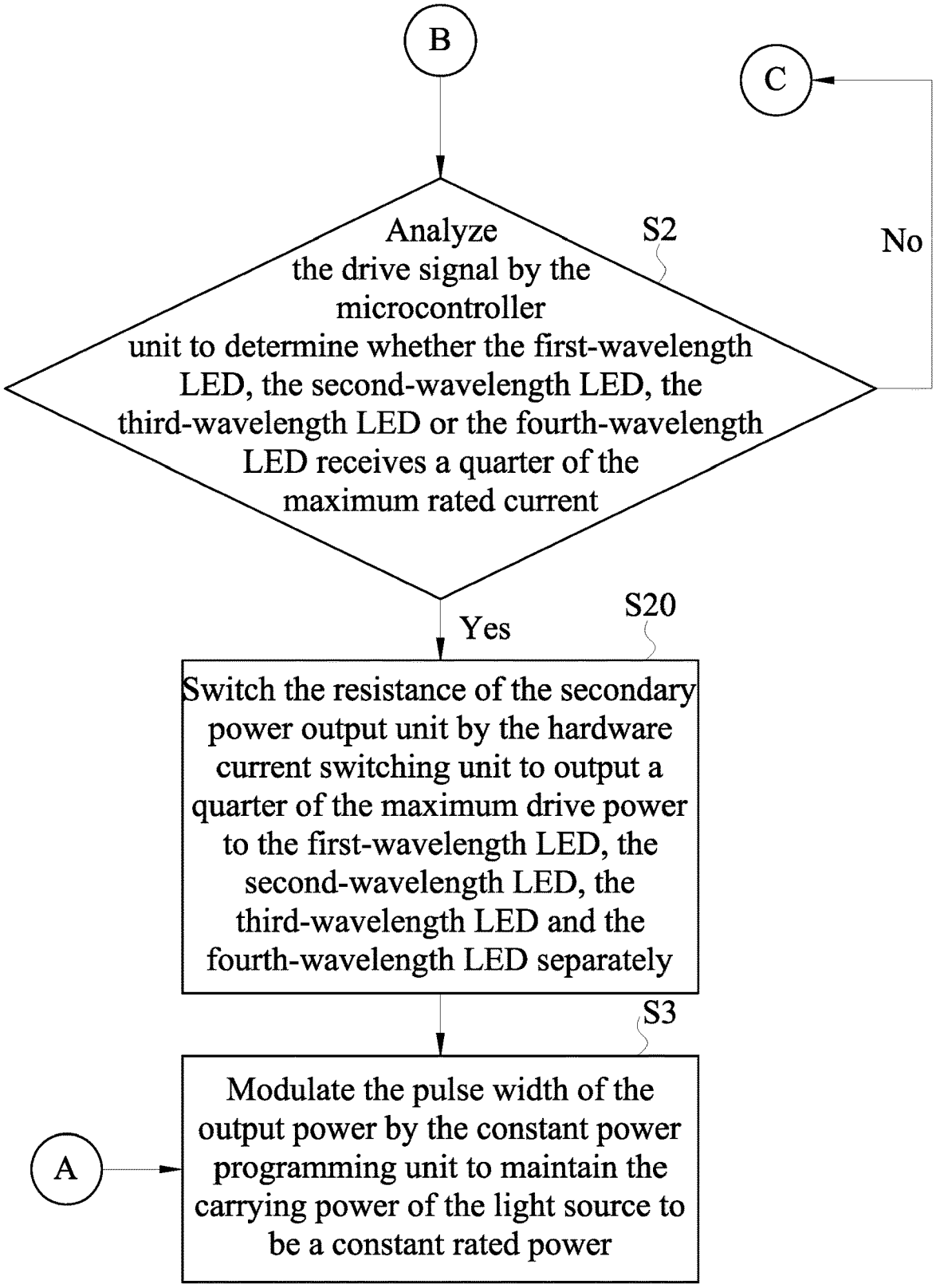

With reference to FIGS. 2, 3A, and 3B for the schematic view and the flow charts of the second preferred embodiment of this disclosure respectively, the LED lighting device capable of adjusting color temperature 1 using a software and hardware cooperative control to achieve the high-performance light output includes at least one light source 10, a drive circuit 11, a modulator 12 and a cooling element 13. The light source 10 is electrically connected to the drive circuit 11, and the cooling element 13 is connected to at least one of the light source 10 and the drive circuit 11. The light source 10 includes a first-wavelength LED 100, a second-wavelength LED 101, a third-wavelength LED 102 and a fourth-wavelength LED 103, and the drive circuit 11 includes a primary power output unit 110, a microcontroller unit 111, a hardware current switching unit 112, a secondary power output unit 113 and a constant power programming unit 114, and the secondary power output unit 113 has an output control element such as a MOSFET for controlling a power outputted by the secondary power output unit 113. The microcontroller unit 111 is telecommunicatively coupled to the hardware current switching unit 112, and the secondary power output unit 113 is electrically coupled to the primary power output unit 110, the hardware current switching unit 112 and the constant power programming unit 114, and the primary power output unit 110 outputs a maximum drive power to the secondary power output unit 113. It is noteworthy that the first-wavelength LED 100, the second-wavelength LED 101, the third-wavelength LED 102 and the fourth-wavelength LED 103 which are a red LED, a green LED, a blue LED and a white LED respectively, and. The flow chart of the operation of the LED lighting device capable of adjusting color temperature 1 includes the following steps:

The modulator 12 can be telecommunicatively coupled to the microcontroller unit 111 through the Remote Device Management (RDM) protocol and Digital Multiplex (DMX) protocol to transmit a drive signal for modulating and adjusting the color temperature. Step S1: When the microcontroller unit 111 receives the drive signal, the drive signal is analyzed to determine whether only one of the first-wavelength LED 100, the second-wavelength LED 101, the third-wavelength LED 102 and the fourth-wavelength LED 103 receives a maximum rated current (such as 1.4 A). If yes, then go to Step 10, or else go to Step 2.

Step S10: The microcontroller unit 111 drives the hardware current switching unit 112 to switch the resistance of the output control element of the secondary power output unit 113 to output four times of the maximum drive power to the corresponding first-wavelength LED 100, second-wavelength LED 101, third-wavelength LED 102 or fourth-wavelength LED 103.

Step S3: The constant power programming unit 114 modulates the pulse width of the output power by a PWM technology to maintain the carrying power of the light source 10 to be a constant rated power.

Step S2: The microcontroller unit 111 analyzes and determines whether the drive signal indicates that the first-wavelength LED 100, the second-wavelength LED 101, the third-wavelength LED 102 and the fourth-wavelength LED 103 receive a quarter of the maximum rated current such as 0.35 A separately. If yes, then go to Step S20.

Step 20: The hardware current switching unit 112 switches the resistance of the output control element to make the secondary power output unit 113 output a quarter of the maximum drive power to the first-wavelength LED 100, the second-wavelength LED 101, the third-wavelength LED 102 and the fourth-wavelength LED 103 separately, and the Step S3 is carried out to modulate the pulse width of the output powerby the constant power programming unit 114 in order to maintain the carrying power of the light source 10 to be a constant rated power. In addition, the cooling element 13 has power dissipation wattage equal to the rated power wattage such as 100 W carried by the light source 10.

What is claimed is:

1. An LED lighting device capable of adjusting color temperature by software and hardware cooperative control to achieve high-performance output, comprising:

at least one light source, comprising a first-wavelength LED, a second-wavelength LED, a third-wavelength LED and a fourth-wavelength LED; and a drive circuit, electrically coupled to the light source, and comprising a primary power output unit, a microcontroller unit, a hardware current switching unit, a secondary power output unit and a constant power programming unit, and the microcontroller unit being telecommunicatively coupled to the hardware current switching unit, and the secondary power output unit being electrically coupled to the primary power output unit, the hardware current switching unit and the constant power programming unit, and the primary power output unit outputting a maximum drive power to the secondary power output unit, wherein when the microcontroller unit receives a drive signal to learn that only one of the first-wavelength LED, the second-wavelength LED, the third-wavelength LED and the fourth-wavelength LED receives a maximum rated current, the hardware current switching unit switches the resistance of the secondary power output unit to output four times of the maximum drive power to the corresponding first-wavelength LED, second-wavelength LED, third-wavelength LED or fourth-wavelength LED, and the constant power programming unit modulates a pulse width of a output power to maintain carrying power of the light source to be a constant rated power; when the microcontroller unit receives the drive signal to learn that the first-wavelength LED, the second-wavelength LED, the third-wavelength LED and the fourth-wavelength LED receive a quarter of the maximum rated current separately, the hardware current switching unit switches the resistance of the secondary power output unit to output a quarter of the maximum drive power to the first-wavelength LED, the second-wavelength LED, the third-wavelength LED and the fourth-wavelength LED separately, and the constant power programming unit modulates the pulse width of the output power to maintain carrying power of the light source to be a constant rated power.

2. The adjustable color-temperature LED lighting device according to claim 1, wherein the first-wavelength LED, the second-wavelength LED, the third-wavelength LED and the fourth-wavelength LED are a red LED, a green LED, a blue LED and a white LED respectively.

3. The adjustable color-temperature LED lighting device according to claim 2, wherein the maximum rated current is equal to 1.4 A, and a quarter of the maximum rated current is equal to 0.35 A.

4. The adjustable color-temperature LED lighting device according to claim 3, further comprising a modulator telecommunicatively coupled to the microcontroller unit for transmitting the drive signal.

5. The adjustable color-temperature LED lighting device according to claim 4, wherein the constant power programming unit modulates the pulse width of the output power by a pulse width modulation technology.

6. The adjustable color-temperature LED lighting device according to claim 5, wherein the secondary power output unit has an output control element which is a metal oxide semiconductor field effect transistor (MOSFET).

7. The adjustable color-temperature LED lighting device according to claim 6, further comprising a cooling element coupled to at least one of the light source and the drive circuit, and the cooling element has a power dissipation wattage equal to rated power wattage carried by the light source.

* * * * *